United States Patent [19]

Prodel

[11] 4,269,309

[45] May 26, 1981

[54] BOTTLE PACKAGING

[76] Inventor: Ulrich H. Prodel, Grunstrasse 13, D-4902 Bad Salzuflen 1, Fed. Rep. of Germany

[21] Appl. No.: 91,787

[22] Filed: Nov. 6, 1979

[30] Foreign Application Priority Data

Nov. 8, 1978 [DE] Fed. Rep. of Germany ..... 2848374

[51] Int. Cl.[3] ..... B65D 1/24; B65D 25/10

[52] U.S. Cl. ..... 206/203; 206/427; 206/561; 206/586; 220/21; 220/401

[58] Field of Search ..... 206/139, 201, 203, 427, 206/586, 561; 220/20, 21, 22, 401, 408, 410, 400

[56] References Cited

U.S. PATENT DOCUMENTS

| | | | |
|---|---|---|---|
| 3,066,795 | 12/1962 | Mansfield | 206/139 |
| 3,863,759 | 2/1975 | Prodel | 206/203 |
| 3,972,441 | 8/1976 | Prodel | 206/139 |
| 4,032,007 | 6/1977 | Graser et al. | 206/427 |
| 4,036,391 | 7/1977 | Prodel | 206/427 |
| 4,071,162 | 1/1978 | Steinlein et al. | 206/203 |
| 4,210,265 | 7/1980 | Steinlein | 206/203 |

FOREIGN PATENT DOCUMENTS

| | | | |
|---|---|---|---|
| 2224866 | 11/1973 | Fed. Rep. of Germany | 206/427 |
| 2357979 | 5/1975 | Fed. Rep. of Germany | 206/427 |
| 2525566 | 12/1976 | Fed. Rep. of Germany | 206/427 |

*Primary Examiner*—Joseph Man-Fu Moy

*Attorney, Agent, or Firm*—Robert E. Burns; Emmanuel J. Lobato; Bruce L. Adams

[57] ABSTRACT

A packaging for bottles comprises a plastic bottle case for receiving individual bottles or bottles in a carrier, e.g. a six pack. To prevent the bottles from bumping one another during transport, the case is provided with spacers which project up from the bottom. Each spacer comprises two angle profiles having flanks at 90° to one another and arranged with the apices of the angle profiles facing one another. The flanks of the angle profiles are offset from one another and from imaginary center lines passing between the profiles. The two flanks of each profile are connected at their tops by an integral roof portion. The bottle carriers are made of cardboard with side walls and partitions. The bottoms of the carriers have openings to accommodate the spacers in the case. By reason of the offset of the profiles forming the spacers, the openings in the bottom of the carriers are spaced apart to provide bridge portions connecting bottle-supporting areas of the bottom with one another.

8 Claims, 5 Drawing Figures

BOTTLE PACKAGING

FIELD OF INVENTION

The present invention relates to a bottle packing comprising a plastic bottle case for the transport of single bottles or bottles contained in a carrier, for example as a four-pack or six-pack. Spacers which project up from the bottom of the case in the space between adjacent bottles keep the bottles from bumping one another during handling and shipping. The invention further comprises bottle carriers which are adapted to be received in the bottle case and have openings in their bottoms to accommodate the spacers provided in the bottle case.

BACKGROUND OF THE INVENTION

Such bottle packings are known in various forms. The embodiment of DE-TS No. 22 24 866 was basic in that it made it possible for the first time to put bottle carriers for two rows of bottles in a bottle case which was also suitable for the transport of single bottles. The bottle case used was characterized in that it was provided with partition walls and with column-like spacers of which the partition walls were so arranged to define a compartment for each bottle carrier with at least one spacer provided in each compartment and projecting up from the bottom of the case. These spacers were so formed, that they projected through openings in the bottom of the bottle carriers placed in the case in such position as to project in the space between bottles in the bottle carrier. A variety of bottle carriers could be used in such bottle case. Especially significant was the possibility of using bottle carriers in the form of a wrap-around carton without end walls which holds six bottles. With a bottle carrier of this kind, the bottles in the carton all contact one another. This has the result that the spacer can be provided only in the space between four contacting bottles. During transport individual bottles are secured in standing position by the spacers but they can contact one another during transport and thereby produce objectionable noise. If the bottle carrier used have the form of a box with a bottom and four side walls, the spacers can be provided with wings so as to give the spacers a star form in cross section whereby these wings extend between individual bottles and keep them from contacting one another so long as they are in a plastic case. However, if these box form bottles carriers are taken out of the case, the bottles contact one another and can strike one another so as to produce noise.

Another form of bottle case which is suitable for receiving bottle carriers with bottles is known through DE-OS No. 26 22 801. In this case two spacers are used for a bottle carrier for six bottles. The spacers have in cross section the form of a quarter circle while between them there is an elongated spacer in the form of an S. These elongated spacers can, however, present the bottles from striking one another only when they are in the plastic case but not in the bottle carrier. In this embodiment the bottle carrier must have an especially stiff bottom since, by reason of the required long openings in the bottom to accommodate the spacers in the case, there is the danger that the bottles will fall out through these openings and that the bottom through the weight of the liquid filled bottles will break.

In order to prevent the bottles from striking one another during their transport in the bottle carrier, it is necessary to use a bottle carrier which is divided into compartments. Such bottles carriers can be made of cardboard. An example is shown in U.S. Pat. No. 4,071,162 which also shows a bottle case which is provided with spacers. The spacers are in the form of four adjacent columns with transverse slits between the spacers of a pair so that the partition walls of the bottle carriers can be received in these spaces when the bottle carriers are placed in the case. However, these four columns are not able to keep individual bottles from striking one another when placed in the plastic case without bottle carriers. A plastic bottle case of this kind with four columns as spacers for four bottles is extraordinarily difficult to produce because the four columns with their enclosed slots can take no more room than prior spacers. Hence, four extraordinarily thin cores are required to produce the hollows in the four columns. These four cores cannot be cooled. This has the result that after the molding of the case, the four columns are warmer than the casing wall. Upon opening the injection mold, the four columns are easily deformed which renders the plastic case unusable. If time is allowed for the columns to cool to a lower temperature, the production rate of the molding machine is decreased and there is the danger that the very thin cores may be broken off when removing the molded case.

SUMMARY OF THE INVENTION

The present invention eliminates these disadvantages. It is an object of the invention to form a bottle case for use with cardboard bottle carriers with partitions in such manner that the spacers in the case have no hollow spaces and prevent the bottles from touching one another when transporting single bottles without carriers.

In accordance with the invention, each spacer consists of a pair of right angle profiles which are offset relative to one another and relative to an imaginary center line, with their apices directed toward one another and with flanks disposed at a right angle to one another.

In the bottle case of the bottle packing in accordance with the invention, pairs of essentially angular profiles are used as spacers. These profiles are offset in a specific manner relative to one another and relative to imaginary center lines. For the production of such angular spacers, it is not necessary to use a core which can be torn out when removing the case from the mold. These angle profiles serving as spacers can be moled in the same simple manner and with the same precision as the known inner walls of bottle cases. Thereby it is assured that individual bottles in the bottle case cannot contact one another during transport. At the same time, the openings formed in the bottom of a bottle carrier to accommodate the spacers are such that the bottom of the bottle carrier is weakened very little.

When the bottle case is used to hold bottle carriers having six or more bottles in two rows, it is advantageous for the profiles of neighboring spacers to be offset relative to one another and relative to a line through the central points of the spacers. This serves to maintain the bottom stability of a bottle carrier made of cardboard.

It is especially advantageous in this case when the facing flanks of two adjacent profiles of two adjacent spacers are spaced from one another a distance which is a multiple of the spacing of each flank from the imaginary center line. This provides a relatively great spacing between the ends of the profiles of adjacent spacers so that the bottom of a cardboard carrier has a relatively great distance between openings provided for the spacers of the bottle case. In spite of this relatively great spacing, there is no danger that the bottles can strike one another when transporting individual bottles in the case without carriers.

In order to increase the stability of the profiles serving as spacers, it is advantageous to connect the upper ends of the profile flanks with an integral connecting portion.

The two flanks of a profile forming a spacer can be joined with one another in a right angle apex. Another possibility is for the two flanks to be connected by a connecting portion which forms an angle of 135° with the flanks. This form has the advantage that the bottom stability of the bottle carriers is enhanced by the relatively wide space between the apices of the two angular profiles forming a spacer.

Bottle carriers for use in the bottle packing according to the invention are characterized in that two separate openings are formed in the bottom for each spacer with a space between the openings. Preferably these openings are angular, i.e. either triangular or in the form of two flanks at a right angle to one another with a connecting portion between the two openings for each spacer. The apices of these openings face one another in a diagonal direction. With bottle carriers for six or more bottles, there can be a greater distance between adjacent spacers which is a multiple of the spacing of the flanks from an imaginary center line.

BRIEF DESCRIPTION OF DRAWINGS

The nature and objects of the invention will be more fully understood from the following description in conjunction with the accompanying drawings which show schematically preferred embodiments of the invention. In the drawings.

DESCRIPTION OF PREFERRED EMBODIMENTS

Figure 1:
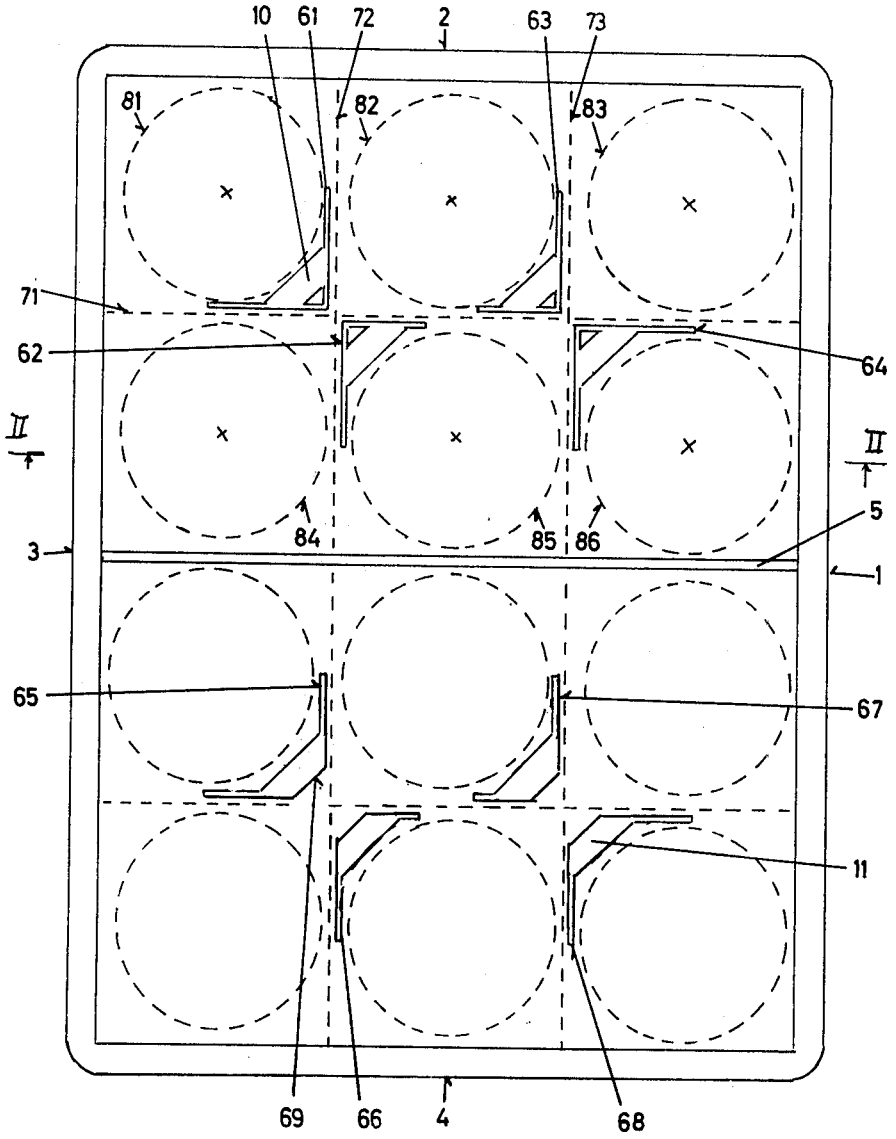
FIG. 1 is a top plan view of a bottle case for receiving two bottle carriers each with six bottles, the spacers in the upper half being different from those in the lower half.

The bottle case of FIG. 1 has four side walls 1, 2, 3 and 4 and an inner wall 5 which divides the interior of the bottle case into two halves. This bottle case is designed to receive twelve individual bottles or two bottle carriers each with six bottles. Spacers are provided in the case to prevent the bottles from striking one another during transport. In the upper half of the illustration in FIG. 1, these spacers consist of pairs of angle profiles 61, 62 and 63, 64 which are offset from one another and from imaginary center lines 71, 72 and 73. The center line 71 runs between two rows each of three bottles while the center lines 72 and 73 are at right angles to the center line 71 and run between two rows each of two bottles. Bottles 81, 82, 83, 84, 85 and 86 are shown in dotted lines. With reference to bottles 81, 82, 84 and 85, it will be seen that the angle profiles 61, 62 forming a spacer between bottles 81, 82, 84 and 85 are offset relative to one another and offset relative to the center lines 71, 72 so that the apices of these angle profiles are spaced from one another. This is important when forming the bottom of the bottle carrier out of cardboard because the bottom portions for supporting bottles 82, 84 are integrally connected with one another. The two flanks of each of the angle profiles 61, 62, 63 and 64 are connected at their upper ends by a connecting portion 10 in the nature of a band or roof.

Figure 2:
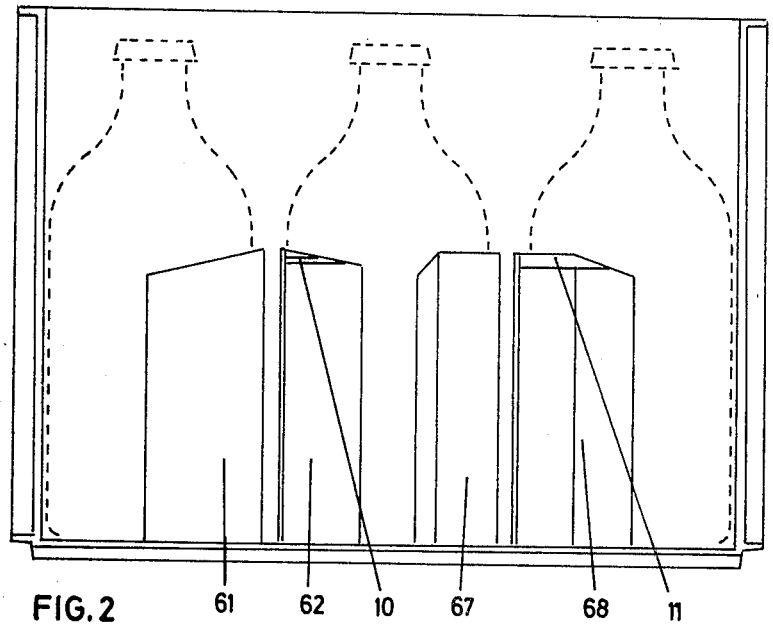
FIG. 2 is a section taken approximately on the line II—II in FIG. 1.

The arrangement of the profile pair 61, 62 of one spacer relative to the profile pair 63, 64 of the other spacer in the upper half of the bottle case shown in FIG. 1 is such that the profiles 62, 63 of adjacent spacers are offset relative to one another and relative to the line 71 which passes through the central points of the spacers. In this manner it follows that between the profiles 62, 63 there is a space which is a multiple of the space between the flanks of the profiles and the imaginary center lines. By reason of the offset positions of the profiles 62, 63, this relatively great space can be provided without permitting the bottles 82, 85 to contact one another during transport. This great space is important in that the bottom of a cardboard bottle carrier is not unnecessarily weakened. The stability of the bottom is thereby assured that the supporting surface for the bottle 82 is connected with the supporting surface for the bottle 85 by a relatively wide bottom portion between the angle profiles 62 and 63. The two flanks of each of the profiles 61–64 join one another in a right angle apex. As seen in FIG. 2, the height of the spacers is at least approximately equal to half the depth of the case so as to engage the bottles above their centers of gravity.

There is also the possibility, as illustrated in the lower half of FIG. 1, that the two flanks of angle profiles 65, 66, 67 and 68 are joined with one another by an integral connecting portion 69 disposed at an angle of 135° to the flanks. This provides a still greater space between angle profiles 65 and 66 and likewise between profiles 67 and 68. The openings for the profiles in the bottom of the bottle carrier are thereby spaced further apart so as to provide a still stronger bottom. Here likewise there is provided an integral roof portion 11 which connects the two flanks of each of the angular profiles 65, 68 at their tops.

Figure 3:
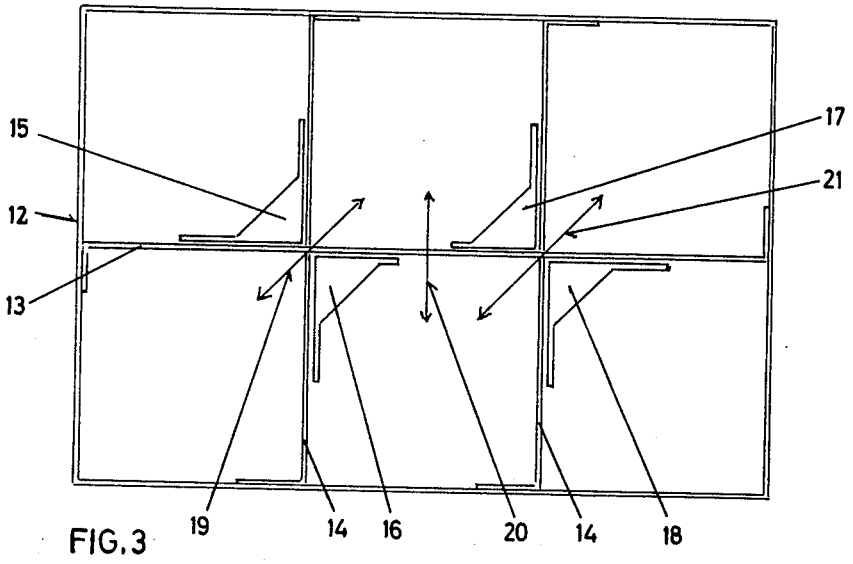
FIG. 3 is a top plan view of a bottle carrier made of cardboard which is shown insertable in the upper half of the bottle case of FIG. 1.
Figure 4:
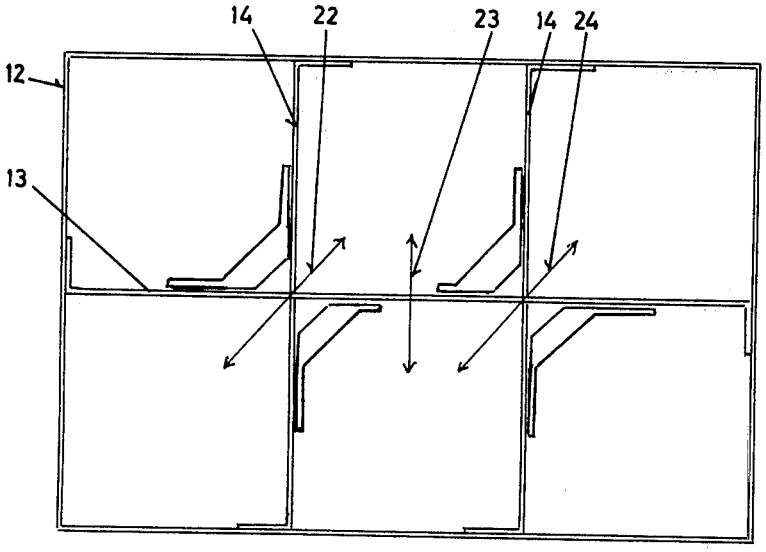
FIG. 4 is a top plan view of a bottle carrier made of cardboard which is insertable in the lower half of the bottle case of FIG. 1.

With reference to FIGS. 3 and 4, it will be seen that the bottle carriers have outer walls 12 and inner walls 13 and 14. When the bottle carrier is placed in the bottle case the inner wall 13 extends along the center line 71 while the inner walls 14 extend along center lines 72, 73. Openings 15, 16 and 17, 18 provided in the bottom of the carrier are of such shape as to accommodate the profiles 61, 62, 63 and 64 which extend through the bottom of the bottle carrier. As indicated by the arrows 19, 20 and 21 in FIG. 3, there is enough free space between the openings that the supporting surfaces of the bottles on the bottom of the bottle carrier are integrally connected with one another.

Through the special form of the angle profiles in the lower half of the bottle case shown in FIG. 1, there are still wider bridges between the openings as represented by the arrows 22, 24 so that the bottom of the bottle carrier has an even greater stability. The connection between openings for adjacent spacers, as indicated by the arrows 23 in FIG. 4, is as wide as that along the arrow 20 in FIG. 3.

Figure 5:
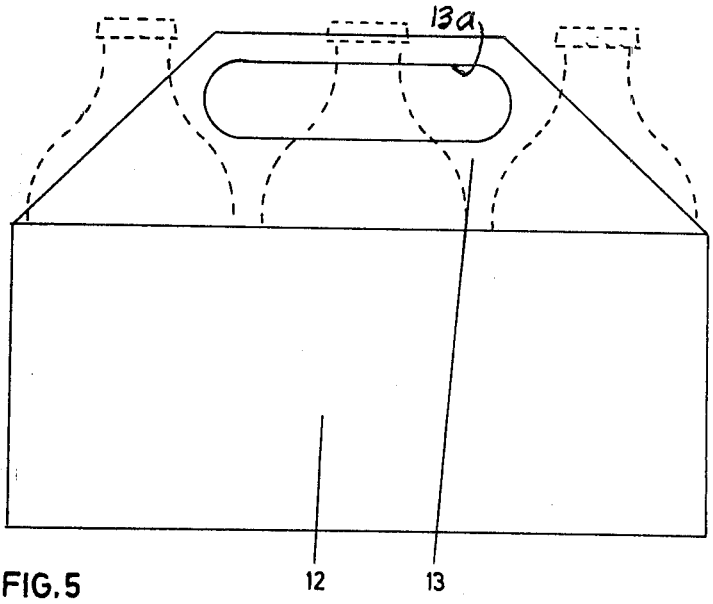
FIG. 5 is a side view of a bottle carrier made of cardboard.

As seen in FIG. 5, the center wall 13 of the bottle carrier extends up above the side walls 12 and is provided with a hand grip opening 13*a*.

The bottle case in accordance with the present invention is especially advantageous for use with cardboard bottle carriers having partitions and a bottom of relatively light cardboard because the openings in the bottom of the bottle carrier for spacers provided in the bottle case are spaced so that the supporting portions for the bottles are connected with one another. The production of the angular profiles integral with the bottle case from plastic material by injection molding can be carried out without difficulty. Through these angular profiles, it is assured that individual bottles in the case without bottle carriers are prevented from striking one another during transport.

While two forms of spacers are illustrated in FIG. 1, it will be understood that in actual production all of the spacers of a case are alike. For example all of the spacers are of the kind shown in the upper half of FIG. 1 or all are like the spacers shown in the lower half of FIG. 1. Moreover, other modifications may be made while still retaining the essence of the invention.

What is claimed is:

1. A bottle packing comprising a plastic bottle case and bottle carriers received in said case, said case having side walls, a bottom and a plurality of spacers projecting up from the bottom in position to provide a spacer in a space between four adjacent bottles, each of said spacers comprising a pair of angular profiles with two flanks disposed at an angle of 90° to one another and with apices of said angular profiles facing one another, the flanks of one angular profile of a pair being parallel to and offset from corresponding flanks of the other angular profile of said pair and offset from imaginary center lines passing between said angular profiles of a pair, and said carrier having side walls and a bottom with holes in said bottom to receive said spacers when said carrier is in said case, said bottom of the carrier having bridge portions extending between the openings for the two angular profiles of a pair of profiles constituting each of said spacers, whereby portions of the bottom of said carrier supporting diagonally opposite bottles are connected by said bridge portions.

2. A bottle packing according to claim 1, in which flanks of two adjacent spacers of said case are spaced from one another a distance which is a multiple of the offset of said flanks from said imaginary center lines, whereby bottle-bearing portions of the bottom of said carrier are connected by bridge portions passing between said spaced flanks.

3. A bottle packing according to claim 1, in which the two flanks of each of said angular profiles are joined with one another by a connecting portion disposed at an angle of 135° to said flanks.

4. A bottle packing according to claim 1 or claim 3, in which upper ends of the two flanks of each of said angular profiles are connected with one another by a roof portion.

5. A bottle packing according to claim 1, in which said openings in the bottom of the carrier are triangular.

6. A bottle packing according to claim 1, in which said carrier has partitions dividing said carrier into compartments one for each bottle, said partitions extending along said center lines of the case when the carrier is in said case.

7. A bottle packing according to claim 1, in which said case has a partition wall dividing said case into two compartments each of a size to receive a carrier holding two rows of bottles.

8. A bottle packing according to claim 1, in which said flanks of each of said angular profiles have parallel side edges and are of a height equal at least to approximately half the depth of said case.

* * * * *